US012516662B2

(12) United States Patent
Franzoni et al.

(10) Patent No.: US 12,516,662 B2
(45) Date of Patent: Jan. 6, 2026

(54) ACTUATION SYSTEM FOR A MOTOR

(71) Applicant: Dana Motion Systems Italia S.R.L., Reggio Emilia (IT)

(72) Inventors: Federica Franzoni, Reggio Emilia (IT); Fabio Natali, Modena (IT); Alessandro Sassi, Reggio Emilia (IT)

(73) Assignee: DANA MOTION SYSTEMS ITALIA S.R.L., Reggio Emilia (IT)

( * ) Notice: Subject to any disclaimer, the term of this patent is extended or adjusted under 35 U.S.C. 154(b) by 236 days.

(21) Appl. No.: 18/188,281

(22) Filed: Mar. 22, 2023

(65) Prior Publication Data

US 2024/0318642 A1 Sep. 26, 2024

(51) Int. Cl.

| | |
|---|---|
| ***F04B 1/20*** | (2020.01) |
| ***F01B 3/00*** | (2006.01) |
| ***F04B 1/2021*** | (2020.01) |
| ***F04B 1/2042*** | (2020.01) |
| ***F04B 1/24*** | (2006.01) |
| ***F04B 1/324*** | (2020.01) |
| ***F04B 1/328*** | (2020.01) |

(52) U.S. Cl.

CPC ..... *F04B 1/20* (2013.01); *F01B 3/0032* (2013.01); *F01B 3/0047* (2013.01); *F01B 3/0055* (2013.01); *F01B 3/0076* (2013.01); *F04B 1/2021* (2013.01); *F04B 1/2042* (2013.01); *F04B 1/24* (2013.01); *F04B 1/324* (2013.01); *F04B 1/328* (2013.01)

(58) Field of Classification Search

CPC .... F04B 1/24; F04B 1/324; F04B 1/20; F04B 1/328; F04B 1/2042; F04B 1/2021; F01B 3/0055; F01B 3/0047; F01B 3/0032; F01B 3/0076

See application file for complete search history.

(56) References Cited

U.S. PATENT DOCUMENTS

| | | | | |
|---|---|---|---|---|
| 3,040,672 | A * | 6/1962 | Foerster | F01B 3/0047 91/487 |
| 3,800,673 | A * | 4/1974 | Lutz | F04B 1/2042 91/487 |
| 6,829,979 | B1 | 12/2004 | Thomas | |
| 2007/0289441 | A1 | 12/2007 | Guggemos et al. | |
| 2013/0055888 | A1 | 3/2013 | Ohno et al. | |
| 2016/0273531 | A1 | 9/2016 | Campbell et al. | |
| 2021/0095647 | A1 | 4/2021 | Parsons et al. | |
| 2022/0106945 | A1 * | 4/2022 | Wustmann | F01B 3/0055 |

FOREIGN PATENT DOCUMENTS

WO 2018215514 A1 11/2018

OTHER PUBLICATIONS

Achten, P. et al., "Experimental Investigation of a Hydrostatic Bearing Between Barrels and Port Plates in Floating Cup Axial Piston Pumps," Proceedings og the 2020 Bath/ASME Symposium on Fluid Power and Motion Control, Sep. 9, 2020, University of Bath, Bath, United Kingdom, 12 pages.

* cited by examiner

*Primary Examiner* — Peter J Bertheaud

(74) *Attorney, Agent, or Firm* — McCoy Russell LLP

(57) ABSTRACT

Methods and systems for a variable balancing piston motor are described. In one example, a hydraulic displacement motor includes a valve plate coupled to at least one piston of a cylinder block, the valve plate comprising a plurality of grooves fluidly coupled to a passage comprising a valve.

12 Claims, 5 Drawing Sheets

ACTUATION SYSTEM FOR A MOTOR

TECHNICAL FIELD

The present disclosure relates generally to hydraulic motors, and more specifically, to a bent axis or an axial motor.

BACKGROUND AND SUMMARY

A hydraulic axial piston motor may be a bent axis motor including a bent axis unit (BAU) rotary group or an axial unit. These units may include a fixed or variable displacement. A balancing of the motor may be predefined during a manufacturing phase, which may influence mechanical and volumetric efficiencies of the motor. Thus, it may be desired to have a motor that may dynamically adjust the balancing of the motor during its operation to optimize its mechanical and volumetric efficiencies.

In one embodiment, at least a portion of the abovementioned issues may be addressed by hydraulic displacement motor including a valve plate coupled to at least one piston of a cylinder block, the valve plate comprising a plurality of grooves fluidly coupled to a passage comprising a valve. By doing this, a balancing of the valve may be adjusted during operation, which may improve its efficiency.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

Various aspects of this disclosure may be better understood upon reading the following detailed description and upon reference to the drawings, in which.

DETAILED DESCRIPTION

Systems are provided for a fixed displacement motor. The motor of the present disclosure may be a variable balancing axial or bent axis piston motor, including a valve plate with one or more cutouts and/or grooves that facilitate the variable balancing described herein in combination with operation of a valve. The fluid may apply a force resulting in an imbalance. Imbalance may also be generated due to vibrations and other conditions. Previous examples of motors are manufactured with an imbalance tolerance that is expected to cover a wide range of operating conditions resulting in imbalance. However, there are conditions that lead to imbalance outside of the imbalance tolerance, especially after a motor has aged. The valve plate includes different areas that may be provided different pressures of hydraulic fluid, and this, in combination with the customized grooves, provides variable balancing of the motor, which may increase mechanical and volumetric efficiency of the unit across a wider range of operating conditions.

Figure 1:
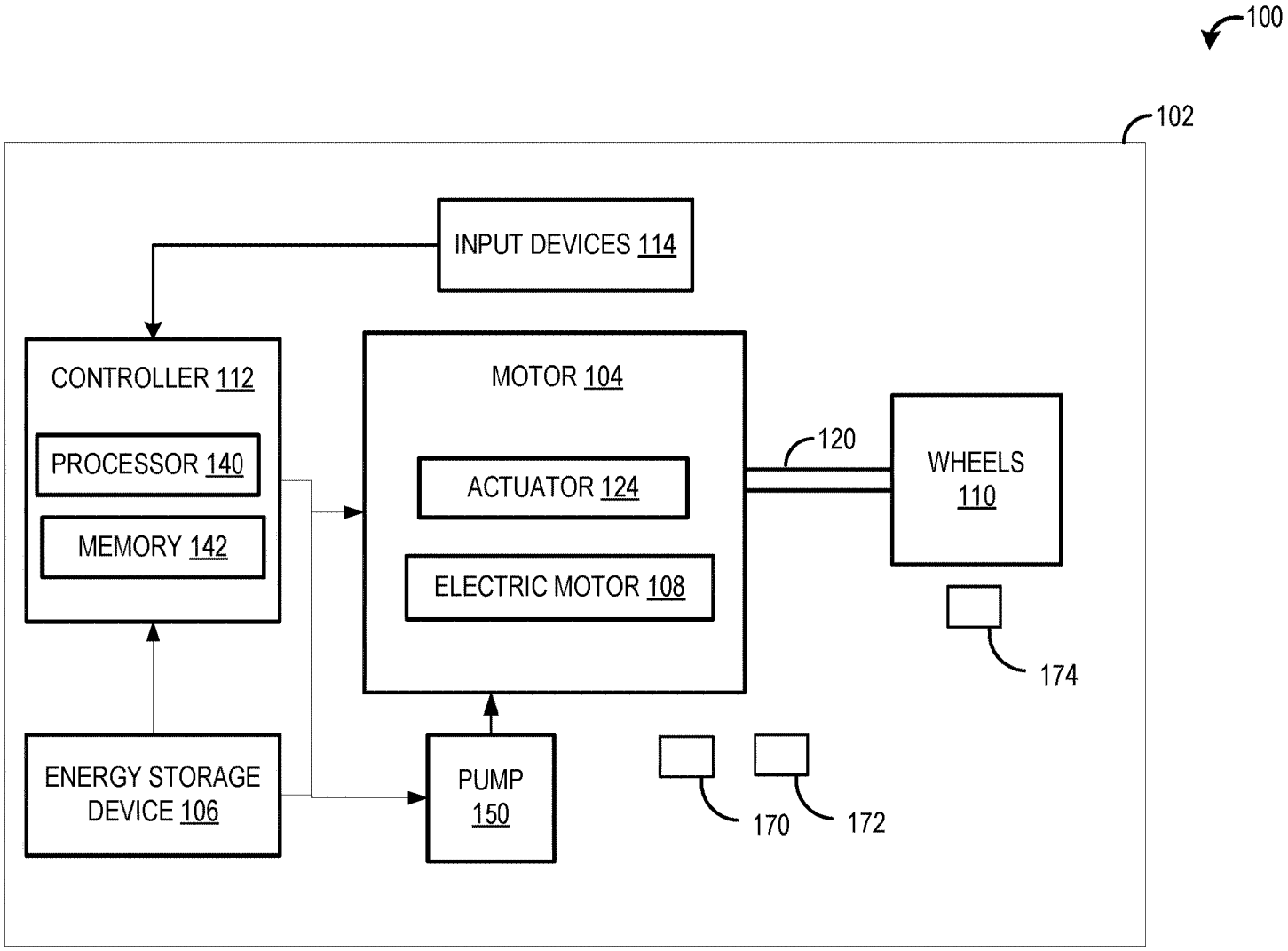
FIG. 1 is a schematic representation of a motor system, in accordance with one or more embodiments of the present disclosure.
Figure 2:
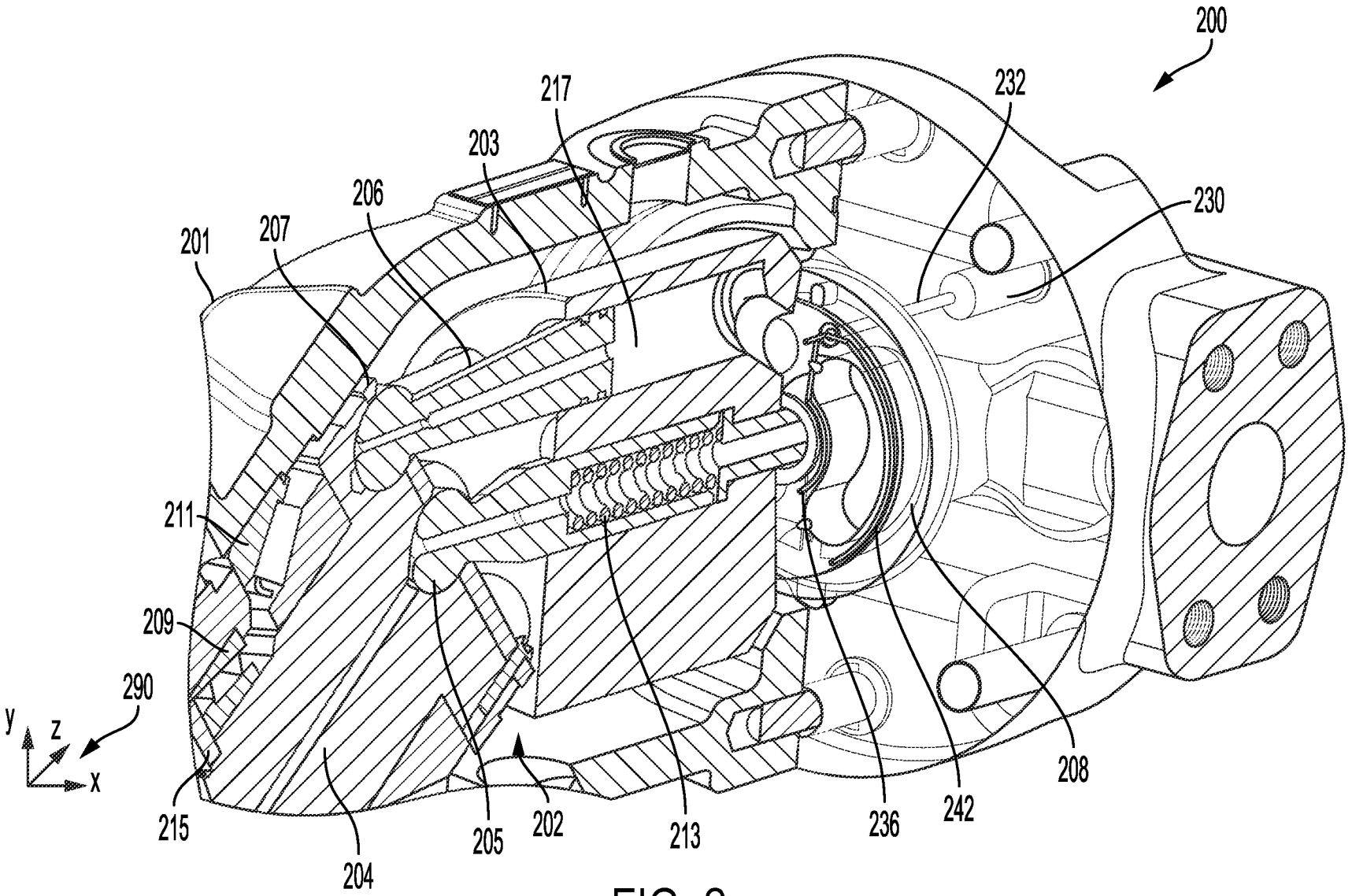
FIG. 2 is a schematic representation of a cross section of a motor including an actuator in a first position, in accordance with one or more embodiments of the present disclosure.
Figure 3:
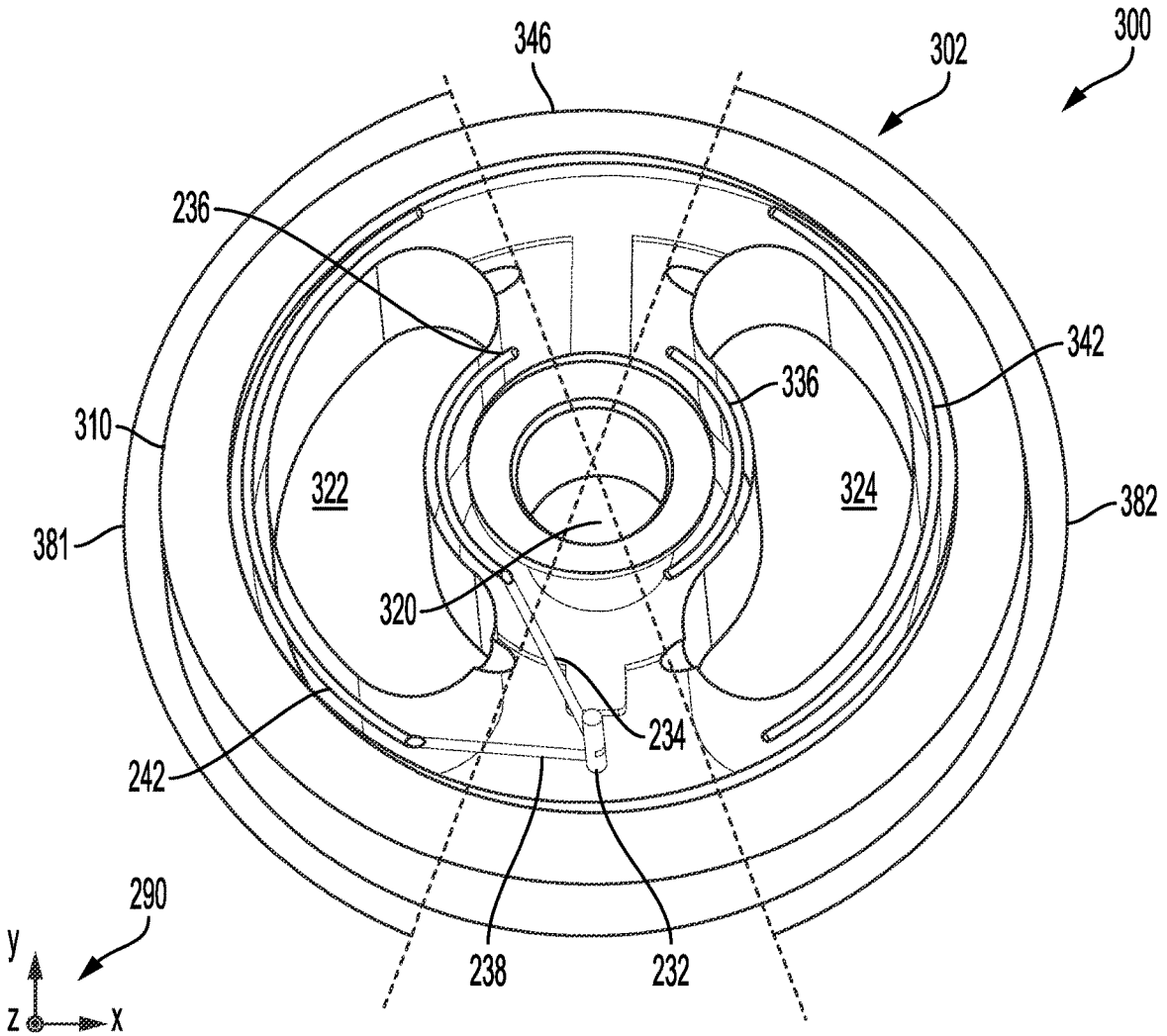
FIG. 3 shows a detailed view of a valve plate of the motor system, in accordance with one or more embodiments of the present disclosure.
Figure 4:
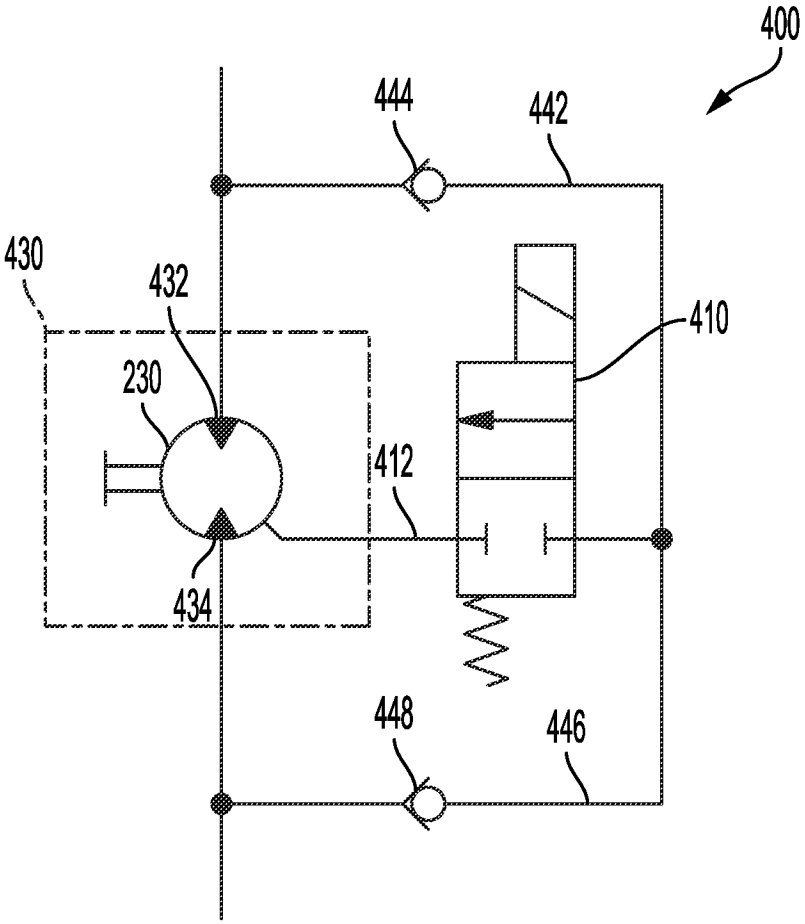
FIG. 4 shows a hydraulic circuit of the motor, in accordance with one or more embodiments of the present disclosure.
Figure 5A:
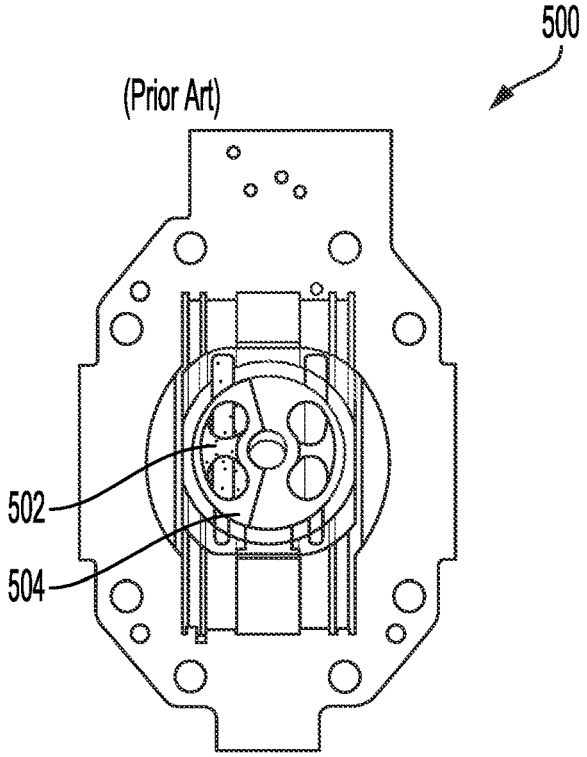
FIGS. 5A and 5B show a difference in fluid distribution between a motor with a valve closed and a motor with a valve at least partially opened in accordance with one or more embodiments of the present disclosure.
Figure 5B:
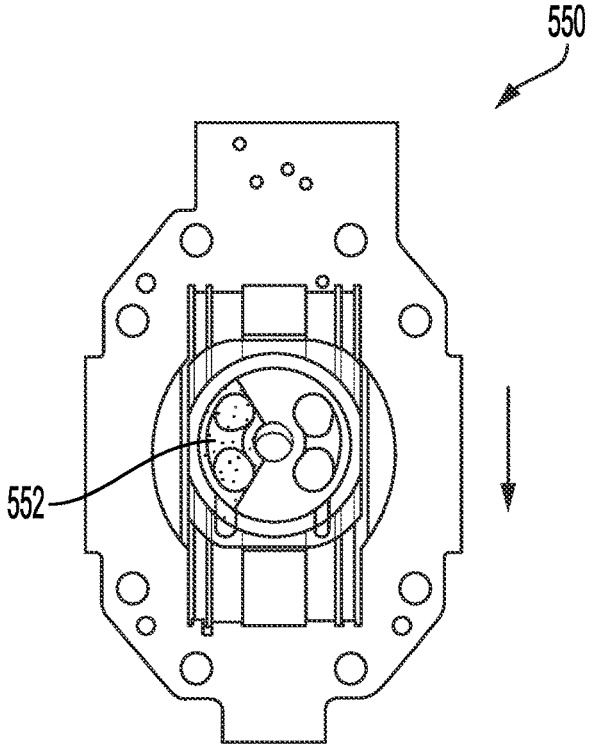

FIG. 1 is a schematic representation of a motor system. FIG. 2 is a schematic representation of a cross section of a motor including an actuator in a first position. FIG. 3 shows a detailed view of a valve plate of the motor system. FIG. 4 shows a hydraulic circuit of the motor. FIGS. 5A and 5B show a difference in fluid distribution between a motor with a valve closed and a motor with a valve at least partially opened.

Referring now to FIG. 1, a schematic depiction of a motor system 100 of a vehicle 102 is shown, including a motor 104 coupled to a controller 112, and to one or more wheels 110 of the vehicle via a drive shaft 120. It should be appreciated that while FIG. 1 refers to an embodiment within a vehicle, in other embodiments, the motor system 100 may be included in a different machine that generates torque for a purpose other than propulsion. The motor may be an axial motor, bent axis motor, or other motor. In one example, the motor is a hydraulic fluid displacement motor.

As the cylinder block rotates, an amount of torque is generated on drive shaft 120 by pressurized hydraulic fluid pumped into motor 104 by a pump 150. The pump 150 may be part of a hydraulic circuit comprising a regulator and valves for controlling the flow of hydraulic fluid. To increase or decrease the amount of torque, a pressure on a side of a valve plate of the rotary group with respect to drive shaft 120 may be adjusted. By adjusting the pressure, a displacement of the rotary group may be increased, causing the amount of torque to increase, or the displacement of the rotary group may be decreased, causing the amount of torque to decrease.

Motor 104 may be indirectly powered by an energy storage device 106 via the pump 150. Specifically, energy stored in energy storage device 106 may be used to power pump 150 which may power an actuator 124 of motor 104, where actuator 124 adjusts balancing of a valve plate to vary the amount of torque delivered at drive shaft 120. In one example, the actuator 124 is an actuator of a valve. Energy storage device 106 may be an energy storage device configured to deliver electrical power to various components of an electrical system of the vehicle 102 including supplying current to motor 104. Energy storage device 106 may be electrically coupled to motor 104, pump 150, and/or controller 112. Controller 112 may regulate the power supply provided by energy storage device 106 to bent axis piston motor 104 in order to increase or decrease a speed of the vehicle 102 via actuator 124. In some examples, the energy storage device 106 may be omitted and the pump 150 and other components may be hydraulically powered.

Controller 112 may include a processor 140 and a memory 142. Memory 142 may hold instructions stored therein that when executed by the processor cause the controller 112 to perform various methods, control strategies, diagnostic techniques, etc. For example, the various methods may include adjusting the pressure applied to the valve plate in contact with pistons of the cylinder block with respect to drive shaft 120, to vary the amount of torque applied to drive shaft 120 (e.g., in response to an operator input). Processor 140 may include a microprocessor unit and/or other types of circuits. Memory 142 may include known data storage mediums such as random access memory, read only memory, keep alive memory, combinations thereof, etc. Memory 142 may include non-transitory memory.

Controller 112 may receive vehicle data and various signals from sensors positioned in different locations in motor 104 and/or vehicle 102. The sensors may include an oil temperature sensor 170, an engine velocity sensor 172, one or more wheel velocity sensors 174, and/or other sensors of motor 104 (e.g., torque sensors, pressure sensors, etc.). Controller 112 may send control signals to one or more actuators of motor 104, in response to operator input and/or based on the received signals from the sensors. For example, controller 112 may adjust a speed and/or torque generated on drive shaft 120 in response to operator input and/or based on the received signals from the sensors.

Motor system 100 may include one or more input devices 114. For example, input devices 114 may include a pedal of the vehicle (e.g., an accelerator pedal), a control stick (e.g., a forward-neutral-reverse (FNR) lever), one or more buttons, or similar types of control, or combinations thereof. In one example, a FNR lever is used to operate the vehicle in a forward direction or a reverse direction, and an accelerator pedal is used to increase or decrease a speed of the vehicle. The input devices 114, responsive to driver input, may generate a torque adjustment request and a desired drive direction (a forward or reverse drive direction). For instance, when a speed adjustment requested is received by the controller, an output speed of the motor 104 may be correspondingly increased.

Motor system 100 may automatically switch between drive modes when demanded. For example, the operator may request a forward or reverse drive mode speed change, and controller 112 may command motor 104 to increase speed and automatically transition between one or more drive ranges associated with the different drive modes, as needed.

Referring now to FIG. 2, a detailed schematic drawing of a motor unit 200 is shown, which may be a non-limiting example of motor 104 described above in reference to FIG. 1. In the example of FIG. 2, the motor unit 200 is a bent axis motor unit (BAU) 200. As described above, the valve and valve plate of the motor unit 200 may be included in bent axis or axial motors. An axis system 290 is shown, comprising three axes, namely an x-axis parallel to a horizontal direction, a y-axis parallel to a vertical direction, and a z-axis normal to each of the x- and y-axes.

BAU 200 includes a BAU rotary group 202, housed within a housing 201 of BAU 200. BAU rotary group 202 includes a cylinder block 203, which houses a plurality of pistons 206 that slide within a corresponding plurality of respective chambers 217 of cylinder block 203. A flange 207 may be rotated by pistons 206 via hydraulic pressure as BAU rotary group 202 is rotated. A central pin 210 may include a holding spring 213, which may provide a force between the cylinder block 203, a valve plate 208, the central pin 210, and a shaft.

BAU rotary group 202 functions as a variator that provides a variable output torque on a drive shaft based on pressures applied to the two sides of a fixed angle valve plate 208, such that a range of movement of the pistons 206 is set by fixed inclination angle between valve plate 208 of BAU rotary group 202 and drive shaft 204. Pistons 206 may be coupled to flange 207 via a universal or ball joint 205.

Flange 207 may be mechanically coupled to drive shaft 204 via a plurality of roller bearings 209 housed within a respective plurality of bearing housings 211, such that as flange 207 is rotated by rotating pistons 206, a rotation of flange 207 is transferred to drive shaft 204. BAU 200 may include a timing gear 215, which may synchronize a piston barrel with the shaft. Housing 201 may include a shaft seal, which may seal BAU 200 around a surface of drive shaft 204.

Chambers 217 are in fluid communication with a hydraulic system, where a hydraulic fluid fills chambers 217 and intervening conduits. Chambers may be coupled to hydraulic conduits through which the hydraulic fluid circulates between the hydraulic system and chambers 217. During operation of bent axis piston motor 200, the hydraulic system may flow the hydraulic fluid to chambers 217 via an inlet hydraulic circuit, and receive the hydraulic fluid back from chambers 217 via an outlet hydraulic circuit.

In one example, the fixed angle valve plate 208 is coupled to a hydraulic circuit via an inlet port 230. A valve may control fluid flow to and from the inlet port 230. An inlet passage 232 may direct fluid from the inlet port 230 to grooves of the valve plate 208. The inlet passage 232 may bifurcate and flow fluid to a first groove 236 and a second groove 242. A first connecting passage 234 may fluidly couple the inlet passage 232 to the first groove 236. A second connecting passage 238 may fluidly couple the inlet passage 232 to the second groove 242. The geometry of the fixed angle valve plate 208 may be adjusted to modify the pressure on at least one side of the fixed angle valve plate 208. That is to say, the fixed angle valve plate 208 may include a first side facing opposite the piston and comprising the grooves fluidly coupled to the inlet port 230 and a second side facing the cylinder block 203. Adjusting the pressure on the second side via the hydraulic circuit may adjust an efficiency of the motor unit 200.

Turning now to FIG. 3, it shows an embodiment 300 of the valve plate 310. Valve plate 310 may be a non-limiting example of valve plate 208 of FIG. 2. The embodiment 300 may illustrate a first side 302 of the valve plate 310 which may interact with one or more pistons, such as pistons 206 of FIG. 2. The valve plate 310 may include a plurality of openings including a central opening 320, a first opening 322, and a second opening 324. The first side 302 of the valve plate may face a direction away from the one or more pistons 206 of FIG. 2.

The first and second openings may surround the central opening 320. The first opening 322 and the second opening 324 may be identical to one another in size and shape and mirror one another about the y-axis. The first opening 322 may be oblong. The second opening 324 may be oblong. In one example, the first opening 322 and the second opening 324 may comprise a bean shape or a kidney shape. That is to say, the first opening 322 and the second opening 324 may comprise a curved shape that tracks a curvature of the valve plate 310.

The first opening 322 may be between the first groove 236 and the second groove 242. The first groove 236 may be between the first opening 322 and the central opening 320. The second groove 242 may be between the first opening 322 and an outer rim 346 of the valve plate 310. The first groove 236 and the second groove 242 may be curved and match a curvature of the central opening 320, the first opening 322, and the outer rim 346. In one example, a cross-section of the grooves may include a half-circle shape.

The valve plate 310 may further include a third groove 336 and a fourth groove 342. The third groove 336 may be identical to the first groove 236. The fourth groove may be identical to the second groove 242. The third groove 336 may be between the central opening 320 and the second opening 324. The fourth groove 342 may be between the second opening 324 and the outer rim 346. In one example, the first groove 236 and the third groove 336 are a first pair and the second groove 242 and the fourth groove 342 are a second pair.

The inlet passage 232 may be fluidly coupled to each of the third groove 336 and the fourth groove 342. By doing this, each of the first, second, third, and fourth grooves may control a pressure on the valve plate 310, which may improve its mechanical and fluid efficiencies.

A size of the grooves may be based at least partially on a corresponding distribution arc length. For example, the first groove 236 and the second groove 242 may comprise arc lengths shorter than a first distribution arc length 381. The third groove 336 and the fourth groove 342 may comprise arc lengths short than a second distribution arc length 382. The first distribution arc length 381 may be identical to the second distribution arc length 382.

In one example, the length of the first groove 236 may be less than the length of the second groove 242. A ratio of the length of the first groove 236 to a corresponding first distribution arc length may be equal to a ratio of the length of the second groove 242 to a corresponding first distribution arc length. Additionally or alternatively, the ratios may be different.

In one example, each of the grooves traverses 5 to 50% of a corresponding circumference of the valve plate. A length and/or a width of the grooves may be adjusted for different operating conditions to achieve desired valve plate balancing. Based on an intended application of the motor, an imbalance tolerance may be adjusted by adjusting the size, shape, length, and number of grooves. The valve may be configured to adjust the imbalance tolerance and restore balance during operation such that the motor is not limited to only the parameters set during manufacture.

In some examples, additionally or alternatively, the inlet passage may be divided into two passages, a first inlet passage coupled to the first and second grooves and a second inlet passage coupled to the third and fourth grooves. The valve may be configured to direct fluid to only the first inlet passage or the second inlet passage based on a position of the valve.

In further embodiments, additionally or alternatively, the inlet passage may be divided into four passages, a first inlet passage coupled to only the first groove, a second inlet passage coupled to only the second groove, a third inlet passage coupled to only the third groove, and a fourth inlet passage coupled to only the fourth groove. As such, a combination of the valve, the inlet passage(s), and the grooves may work in tandem to adjust a variable balancing of the valve plate and reduce power losses.

Turning now to FIG. 4, it shows a fluid circuit 400. The fluid circuit 400 may be a fluid circuit coupled to the motor 104 of FIG. 1 or the BAU 200 of FIG. 2. The fluid circuit 400 comprises a valve 410 fluidly coupled to the inlet port 230 via a connection passage 412. In one example, the connection passage 412 is directly fluidly coupled to the inlet port 230 and controls fluid flow via the valve 410 for variable balancing of the valve plate (e.g., valve plate 310 of FIG. 3 or valve plate 208 of FIG. 2). The inlet port 230 may be included in a fluid port manifold 430 that further includes a first outlet port 432 and a second outlet port 434. The first outlet port 432 may be fluidly coupled to a first return line 442 including a first check valve 444. The second outlet port 434 may be fluidly coupled to a second return line 446 including a second check valve 448. The return lines may return fluid from the motor to the valve 410.

In some examples, additionally or alternatively, the valve 410 may be integrally arranged in the motor. In one example, the valve 410 may be integrally arranged with the inlet port 230 and the outlet ports 432, 434. The valve 410 may include a plurality of positions configured to control fluid flow to the first through fourth grooves along with controlling fluid flow to the outlet ports. Additionally or alternatively, the plurality of positions controlling fluid flow to the grooves may be variable positions, each adjustable to modify fluid flow to each groove. As such, a flow rate to the first groove may be different than a flow rate to the other grooves.

Turning now to FIGS. 5A and 5B, they show examples 500 and 550 of fluid distribution at the valve plate 208 based on a position of the valve, respectively. In the example 500, the valve is closed and high pressure fluid distribution areas are shown via diagonal patterned areas 502 and lower pressure fluid distribution areas are shown via cross-hatch patterned areas 504. This may lead to a heavier valve plate balancing, which may be undesired during certain operating conditions.

In the example 550, the valve is open and high pressure fluid distribution is shown via a diagonal patterned area 552. Due to the higher pressure fluid distribution, the valve plate balancing may be lighter, which may be desired during some conditions. As such, the incorporation of the valve and the grooves may lead to enhancements over previous examples that only experience the fluid pressure distribution of the example of FIG. 5A.

In one example, the valve is open when motor speeds are above a determined motor speed and/or when a working pressure is less than a determined working pressure. When the valve is open, lighter balancing is provided, which increases motor efficiency. The valve and valve plate comprising the grooves may be used in fixed displacement motors and swash plate variable displacement motors.

The disclosure provides support for a hydraulic displacement motor including a valve plate coupled to at least one piston of a cylinder block, the valve plate comprising a plurality of grooves fluidly coupled to a passage comprising a valve. A first example of the motor further includes where a first pair of the plurality of grooves are identical to one another and a second pair of the plurality of grooves are identical to one another, the first pair different than the second pair. A second example of the motor, optionally including the first example, further includes where the first pair comprise a shorter arc length than the second pair. A third example of the motor, optionally including one or more of the previous examples, further includes where each of the plurality of grooves is arc shaped and follows a curvature of a circle. A fourth example of the motor, optionally including one or more of the previous examples, further includes where each of the plurality of grooves traverses 5 to 50% of a corresponding circumference of the valve plate. A fifth example of the motor, optionally including one or more of the previous examples, further includes where the valve plate comprises a central opening engaged with the at least one piston, a first opening, and a second opening identical to the first opening, and wherein the plurality of grooves is arranged between the central opening, the first opening, the second opening, and an outer rim of the valve plate. A sixth example of the motor, optionally including one or more of the previous examples, further includes where the valve is external to the hydraulic displacement motor. A seventh example of the motor, optionally including one or more of the previous examples, further includes where the hydraulic displacement motor is an axial motor or a bent axis motor. An eighth example of the motor, optionally including one or more of the previous examples, further includes where each the plurality of grooves comprises a half-circle cross-sectional shape.

The disclosure provides further support for a fluid displacement motor including a cylinder block in which a plurality of pistons oscillates, a valve plate comprising a central opening through which at least one of the plurality of pistons oscillates and between a first opening and a second opening, the valve plate further comprising a plurality of grooves, a first groove arranged between the central opening and the first opening, a second groove arranged between the first opening and an outer rim of the valve plate, a third groove arranged between the central opening and the second opening, and a fourth groove arranged between the second opening and the outer rim, and a valve arranged in a connecting passage coupled to an inlet port of the fluid displacement motor, the valve configured to control fluid flow to the plurality of grooves. A first example of the motor further includes the first groove and the third groove are identical in size and shape, and wherein the second groove and the fourth groove are identical in size and shape. A second example of the motor, optionally including the first example, further includes where the plurality of grooves is arranged on a side of the valve plate facing the cylinder block. A third example of the motor, optionally including one or more of the previous examples, further includes where an inlet passage extends from the inlet port and divides to flow fluid to each of the plurality of grooves. A fourth example of the motor, optionally including one or more of the previous examples, further includes where the first and third grooves are different in size and shape than the second and fourth grooves. A fifth example of the motor, optionally including one or more of the previous examples, further includes where the first opening is shorter in arc length than the first opening and the second opening is shorter in arc length than the first opening.

The disclosure provides additional support for a fluid displacement motor including a cylinder block in which a plurality of pistons oscillates, a valve plate comprising a central opening through which at least one of the plurality of pistons oscillates and between a first opening and a second opening, the valve plate further comprising a plurality of grooves, a first groove arranged between the central opening and the first opening, a second groove arranged between the first opening and an outer rim of the valve plate, a third groove arranged between the central opening and the second opening, and a fourth groove arranged between the second opening and the outer rim, wherein the first groove is identical to the third groove and the second groove is identical to the fourth groove, and a valve arranged in a connecting passage coupled to an inlet port of the fluid displacement motor, the valve configured to control fluid flow to the plurality of grooves. A first example of the motor further includes where each of the plurality of grooves are fluidly separated from one another. A second example of the motor, optionally including the first example, further includes where an arc length of the first and second grooves is less than a first fluid distribution arc. A third example of the motor, optionally including one or more of the previous examples, further includes where an arc length of the third and fourth grooves is less than a second fluid distribution arc. A fourth example of the motor, optionally including one or more of the previous examples, further includes where the valve plate is symmetrical about a single axis.

While various embodiments have been described above, it should be understood that they have been presented by way of example, and not limitation. It will be apparent to persons skilled in the relevant arts that the disclosed subject matter may be embodied in other specific forms without departing from the spirit of the subject matter. The embodiments described above are therefore to be considered in all respects as illustrative, not restrictive.

Note that the example control and estimation routines included herein can be used with various powertrain and/or vehicle system configurations. The control methods and routines disclosed herein may be stored as executable instructions in non-transitory memory and may be carried out by the control system including the controller in combination with the various sensors, actuators, and other transmission and/or vehicle hardware. Further, portions of the methods may be physical actions taken in the real world to change a state of a device. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for case of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the vehicle and/or transmission control system, where the described actions are carried out by executing the instructions in a system including the various hardware components in combination with the electronic controller. One or more of the method steps described herein may be omitted if desired.

It will be appreciated that the configurations and routines disclosed herein are exemplary in nature, and that these specific embodiments are not to be considered in a limiting sense, because numerous variations are possible. As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

FIGS. 2-5B show example configurations with relative positioning of various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A hydraulic displacement motor, comprising:

a valve plate coupled to at least one piston of a cylinder block and comprising a central opening through which a pin oscillates, the valve plate comprising a plurality of grooves fluidly coupled to a passage comprising a valve, wherein the passage is configured to flow fluid to a first pair of the plurality of grooves between the central opening, a first opening, and a second opening and to a second pair of the plurality of grooves arranged between the first opening and second opening and an outer rim of the valve plate, wherein the valve is external to the hydraulic displacement motor.

2. The hydraulic displacement motor of claim 1, wherein the first pair of the plurality of grooves are identical to one another and the second pair of the plurality of grooves are identical to one another, the first pair different than the second pair.

3. The hydraulic displacement motor of claim 2, wherein the first pair comprise a shorter arc length than the second pair.

4. The hydraulic displacement motor of claim 1, wherein each of the plurality of grooves is arc shaped and follows a curvature of a circle.

5. The hydraulic displacement motor of claim 1, wherein each of the plurality of grooves traverses 5 to 50% of a corresponding circumference of the valve plate.

6. The hydraulic displacement motor of claim 1, wherein the valve is arranged in the passage coupled to an inlet port of the fluid displacement motor, the valve configured to control fluid flow to the plurality of grooves.

7. The hydraulic displacement motor of claim 1, wherein the hydraulic displacement motor is an axial motor or a bent axis motor.

8. The hydraulic displacement motor of claim 1, wherein each the plurality of grooves comprises a half-circle cross-sectional shape.

9. A fluid displacement motor, comprising:

a cylinder block in which a plurality of pistons and a pin oscillate;

a valve plate comprising a central opening through which the pin oscillates and between a first opening and a second opening, the valve plate further comprising a plurality of grooves, a first groove arranged between the central opening and the first opening, a second groove arranged between the first opening and an outer rim of the valve plate, a third groove arranged between the central opening and the second opening, and a fourth groove arranged between the second opening and the outer rim; and a valve arranged in a connecting passage coupled to an inlet port of the fluid displacement motor, the valve configured to control fluid flow to the plurality of grooves, wherein an inlet passage extends from the inlet port and divides to flow fluid to each of the plurality of grooves.

10. The fluid displacement motor of claim 9, wherein the first groove and the third groove are identical in size and shape, and wherein the second groove and the fourth groove are identical in size and shape.

11. The fluid displacement motor of claim 9, wherein the plurality of grooves is arranged on a side of the valve plate facing the cylinder block.

12. The fluid displacement motor of claim 9, wherein the first and third grooves are different in size and shape than the second and fourth grooves.

* * * * *